US005941092A

United States Patent [19]

Tosaki et al.

[11] Patent Number: 5,941,092

[45] Date of Patent: Aug. 24, 1999

[54] REFRIGERATION UNIT

[75] Inventors: Junichi Tosaki; Hiroji Takano, both of Aichi, Japan

[73] Assignee: Hoshizaki Denki Kabushiki Kaisha, Toyoake, Japan

[21] Appl. No.: 09/012,235

[22] Filed: Jan. 23, 1998

[30] Foreign Application Priority Data

Jan. 24, 1997 [JP] Japan ..... 9-025896

[51] Int. Cl.[6] ..... F25D 17/06

[52] U.S. Cl. ..... 62/428; 62/298

[58] Field of Search ..... 62/428, 404, 262, 62/298, 259.2

[56] References Cited

U.S. PATENT DOCUMENTS 2,826,048 3/1958 Wheeler ..... 62/428

FOREIGN PATENT DOCUMENTS 60-4776 2/1985 Japan .
63-192876 12/1988 Japan .
403148575 6/1991 Japan ..... 62/428
5-36277 5/1993 Japan .

*Primary Examiner*—William Doerrler
*Attorney, Agent, or Firm*—Morgan, Lewis & Bockius LLP

[57] ABSTRACT

In a refrigeration unit 4 disposed in a machine room 3 of a refrigerator or the like, an expansion valve cover 11 and a pressure switch mounting plate 12 are disposed in the side of a refrigerant compressor 8 placed behind a fan motor 6, and at positions which are in a lateral side of the refrigerant compressor 8 and separated therefrom by a gap, and which are deviated from the direction along which cooling air from the fan motor 6 is ejected. The cover and the plate are disposed so as to elongate in substantially parallel with a side face of the refrigerant compressor 8. A cooling air passage 20 is formed in each of both the sides of the refrigerant compressor 8.

10 Claims, 2 Drawing Sheets

PRIOR ART FIG. 1
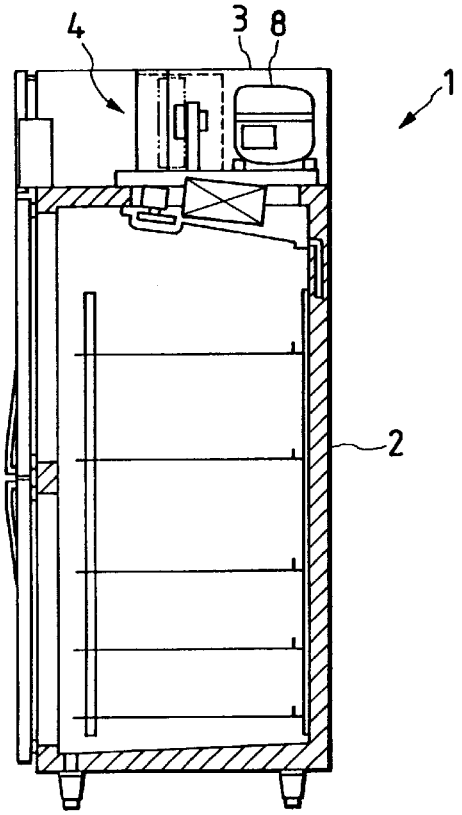
PRIOR ART FIG. 2
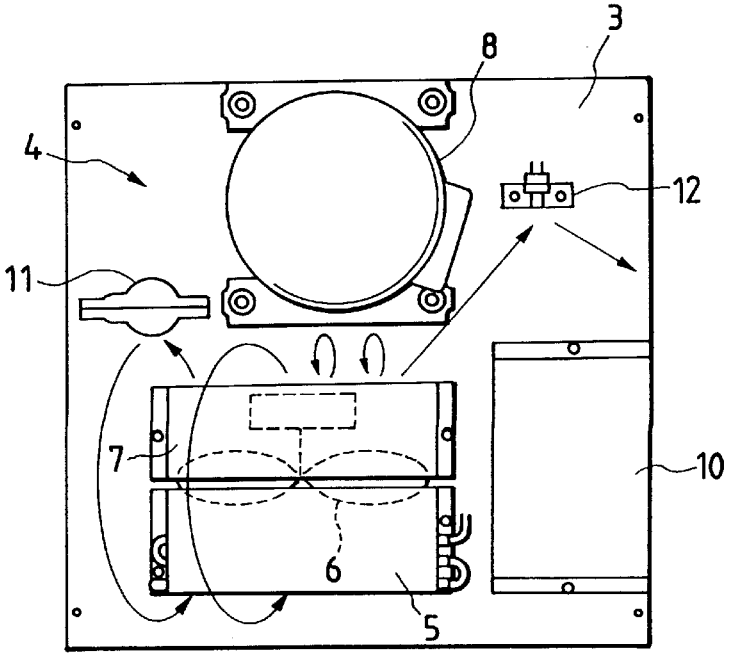

REFRIGERATION UNIT

BACKGROUND OF THE INVENTION

The invention relates to a refrigeration unit in a refrigerator, a freezer, or the like, and particularly to an arrangement of components of the refrigeration unit.

As shown in FIGS. 1 and 2, a refrigerator, a freezer, or the like 1 of the prior art consists of a main unit 2 and a machine room 3 which is disposed above the main unit. A refrigeration unit 4 for cooling the interior of the main unit 2 is disposed in the machine room 3. In the refrigeration unit 4, a fan motor 6 is disposed behind a refrigerant condenser 5, and a fan cover 7 covers the periphery of the fan motor. A refrigerant compressor 8 is disposed behind the fan motor 6. The outside air sucked by the fan motor 6 passes through the refrigerant condenser 5 and is then directly blown to the refrigerant compressor 8 to cool the refrigerant compressor 8.

In the machine room 3, in addition to an electrical equipment box 10, various accessory parts such as an expansion valve cover 11, and a pressure switch mounting plate 12 are adequately disposed around the refrigerant compressor 8. These accessory parts are arranged without specially considering the air flow ejected from the refrigerant condenser 5. As indicated by the arrows in FIG. 2, therefore, the air flow ejected from the refrigerant condenser 5 rebounds on the accessory parts. As a result, there arises a problem in that the air flow reversely moves around the fan cover 7 and is again sucked into the refrigerant condenser 5, thereby lowering the efficiency of the refrigerant condenser 5. Furthermore, the cooling air fails to effectively impinge on the whole of the refrigerant compressor 8, and hence the refrigerant compressor 8 cannot be sufficiently prevented from being overheated.

Moreover, the air ejected from the fan motor 6 rebounds on the accessory parts to form a turbulence flow. Therefore, the load imposed on the fan motor is increased, thereby producing another problem in that the operation efficiency of the fan motor is lowered.

In order to solve these problems, Japanese Patent Examined Publication No. Sho. 60-4776, Japanese Utility Model Unexamined Publication No. Sho. 63-192876, and Japanese Utility Model Unexamined Publication No. Hei. 5-36277, and the like disclose a configuration in which a guide plate such as a wind direction plate, a partition plate, or an air guide plate is attached between a fan motor and a refrigerant compressor. In this configuration, a step of attaching the guide plate is additionally required, whereby the production cost is increased.

SUMMARY OF THE INVENTION

It is an object of the invention to provide a refrigeration unit of a refrigerator, a freezer, or the like in which a refrigerant compressor is always effectively cooled by air ejected from a fan motor, without causing the production cost to be increased.

In order to attain the object, in the refrigeration unit of the invention, a refrigerant condenser, a fan motor, and a refrigerant compressor are sequentially arranged in series, an accessory part is disposed at a position which is in a lateral side of the refrigerant compressor and separated from the refrigerant compressor by a gap, and which is deviated from a direction along which cooling air from the fan motor is ejected, and a cooling air passage is formed in each of both sides of the refrigerant compressor.

In addition, the object can also be attained by a refrigeration unit according to the present invention comprising:

a refrigerant condenser;

a fan motor disposed behind the refrigerant condenser;

a refrigerant compressor disposed behind the fan motor in such a manner that the refrigerant condenser, the fan motor and the refrigerant compressor are sequentially arranged in series; and a number of accessory parts being disposed at positions which are in a lateral side of the refrigerant compressor and separated from the refrigerant compressor so as to define a cooling air passage for a cooling air ejected from the fan motor.

In the above-mentioned refrigeration unit, each of the accessory parts is preferably arranged in such a manner that a longitudinal axis thereof is extended substantially in parallel with a rotational axis of the fun motor.

In the above-mentioned refrigeration unit, the longitudinal axis of one of the accessory parts may be substantially flush with that of the other of the accessory parts.

In addition, in the above-mentioned refrigeration unit, the accessory parts may comprise an expansion valve cover and a pressure switch mounting plate.

Further, in the above-mentioned refrigeration unit, the expansion valve cover and the pressure switch mounting plate are preferably arranged in such a manner that the longitudinal axes thereof are extended substantially in parallel with a rotational axis of the fun motor.

Furthermore, in the above-mentioned refrigeration unit, the longitudinal axis of the expansion valve cover may be substantially flush with that of the pressure switch mounting plate.

Even when the refrigerant compressor is disposed in series with and behind the fan motor and an accessory part is disposed in the periphery of the refrigerant compressor, cooling air ejected from the fan motor is directly blown to the refrigerant compressor with maintaining its straightened state and without impinging on the accessory part to cool the compressor because the accessory part is disposed at a position which is in a lateral side of the refrigerant compressor and separated therefrom by a gap, and which is deviated from the direction along which the cooling air from the fan motor is ejected. Thereafter, the cooling air smoothly flows while passing through the cooling air passages respectively formed in both the sides of the refrigerant compressor, to the back of the refrigerant compressor, with the result that the whole of the refrigerant compressor can be effectively cooled.

The nature, utility and principle of the invention will be more clearly understood from the following detailed description and the appended claims when read in conjunction with the accompanying drawings.

BRIEF DESCRIPTION OF THE DRAWINGS

FIG. 1 is a schematic longitudinal section view of a refrigeration unit of the prior art;

FIG. 2 is an enlarged plan view showing main portions of the unit of the prior art;

DETAILED DESCRIPTION OF THE PREFERRED EMBODIMENTS

Figure 3:
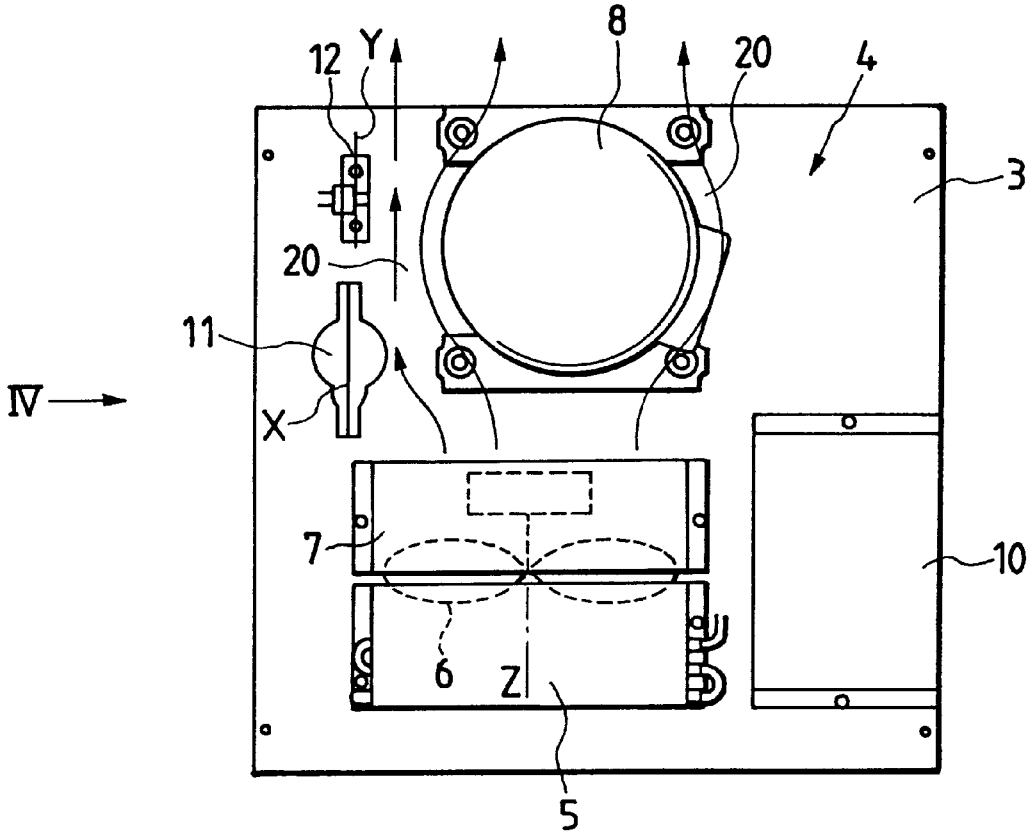
FIG. 3 is a plan view showing main portions of an embodiment of the invention.

Hereinafter, an embodiment of the invention will be described. Components which are equivalent to those of the prior art example are designated by the same reference numerals.

Figure 4:
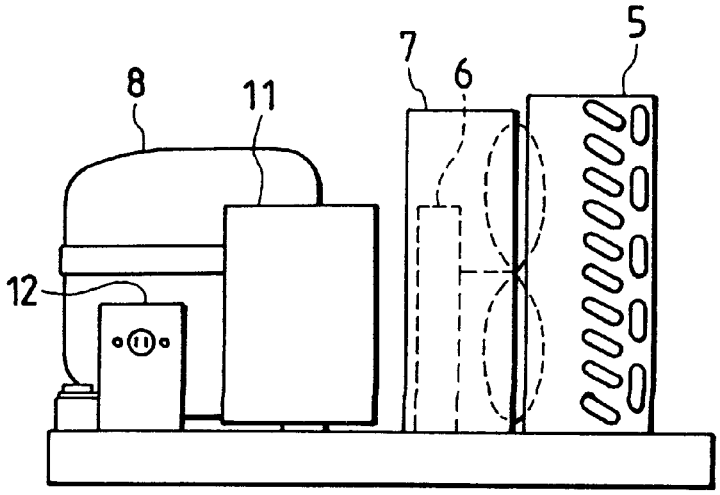
FIG. 4 is a view as seen in the direction of the arrow IV in FIG. 3.

Referring to FIGS. 3 and 4, in the same manner as the prior art example, a refrigeration unit 4 for cooling the interior of a main unit of a refrigerator, a freezer, or the like is disposed in a machine room 3 which is positioned on the main unit. In the refrigeration unit 4, a refrigerant condenser 5, a fan motor 6, and a refrigerant compressor 8 are sequentially arranged in series, and a fan cover 7 covers the periphery of the fan motor 6.

An expansion valve cover 11 and a pressure switch mounting plate 12 which are accessory parts of the refrigeration unit 4 are disposed at positions which are in a lateral side of the refrigerant compressor 8 and separated therefrom by a gap, and which are deviated from the direction along which cooling air from the fan motor 6 is ejected. The accessory parts are disposed so as to elongate in substantially parallel with a side face of the refrigerant compressor 8. A cooling air passage 20 is formed in each of both the sides of the refrigerant compressor 8.

Namely, as shown in FIG. 3, the expansion valve cover 11, the pressure switch mounting plate 12, and the fan motor 6 are arranged in such a manner that a longitudinal axis X of the expansion valve cover 11 and a longitudinal axis Y of a pressure switch mounting plate 12 are respectively extended in parallel with a rotational axis Z of the fun motor substantially. In addition to this, the longitudinal axis X of the expansion valve cover 11 preferably and substantially flush with the longitudinal axis Y of the pressure switch mounting plate 12.

Therefore, the outside air sucked by the fan motor 6 passes through the refrigerant condenser 5. As indicated by the arrows in FIG. 3, the cooling air ejected from the fan motor 6 is directly blown to the refrigerant compressor 8 with maintaining its straightened state, and then smoothly flows to the back of the refrigerant compressor 8 while passing along the sides of the refrigerant compressor 8 and through the cooling air passages 20. At this time, since the expansion valve cover 11 and the pressure switch mounting plate 12 are disposed so as to be substantially parallel with the side face of the refrigerant compressor 8, each of the expansion valve cover 11 and the pressure switch mounting plate 12 naturally exerts a function of guiding the cooling air so as to flow along the side face of the refrigerant compressor 8. Therefore, any special guide plate or the like is not required.

Specifically, the cooling air ejected from the fan motor 6 is directly blown to the refrigerant compressor 8 with maintaining its straightened state and without impinging on the expansion valve cover 11 and the pressure switch mounting plate 12. Furthermore, the cooling air smoothly flows to the back of the refrigerant compressor 8 while passing along the sides of the refrigerant compressor 8 and through the cooling air passages 20, so as to be sufficiently supplied to the whole of the refrigerant compressor 8. Therefore, the refrigerant compressor 8 is cooled very effectively with the result that it can be surely prevented from being overheated.

Moreover, the cooling air ejected from the fan motor 6 does not form a turbulence flow due to a rebound from the expansion valve cover 11 or the pressure switch mounting plate 12, and maintains its straightened state. Unlike the prior art example, therefore, a phenomenon in which turbulent cooling air reversely flows around the fan cover 7 and is again sucked into the refrigerant condenser 5 to reduce the efficiency of the refrigerant condenser 5 does not occur. Moreover, the load imposed on the fan motor 6 is not increased. Therefore, the embodiment has an effect that the operation efficiency of the fan motor 6 is always satisfactorily maintained and a fault of the fan motor 6 is easily prevented from occurring.

Furthermore, it is entirely unnecessary to dispose a special guide plate or the like for regulating the flow of the cooling air, in the machine room 3. Therefore, a step of attaching such a guide plate is not required. Consequently, the embodiment has a great practical advantage that the above-mentioned effects can be attained without increasing the production cost.

In the refrigeration unit of the invention, cooling air ejected from the fan motor is directly blown to the refrigerant compressor with maintaining its straightened state and without impinging on the accessory part, and smoothly flows to the back of the refrigerant compressor while passing through the cooling air passages respectively formed in both the sides of the refrigerant compressor, with the result that the whole of the refrigerant compressor can be effectively cooled. Furthermore, since the cooling air ejected from the fan motor does not form a turbulence flow, a phenomenon in which the turbulent cooling air is again sucked into the refrigerant condenser to reduce the efficiency of the refrigerant condenser or to increase the load imposed on the fan motor does not occur. Moreover, it is entirely unnecessary to dispose a special guide plate or the like for the cooling air, and hence the invention has great advantages such as that a step of attaching a guide plate or the like is not required.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A refrigeration unit, comprising:

a refrigerant condenser;

a fan defining an axis;

a refrigerant compressor; and an accessory part, wherein said refrigerant condenser, said fan motor, and said refrigerant compressor are disposed along the axis of said fan, and wherein said accessory part is disposed at a lateral side of said refrigerant compressor to define a cooling air passage between said accessory part and said refrigerant compressor, the cooling air passage being oriented in a direction along which air is ejected from said fan.

2. A refrigeration unit, comprising:

a refrigerant condenser;

a fan disposed behind said refrigerant condenser;

a refrigerant compressor disposed behind said fan, said refrigerant condenser, said fan and said refrigerant compressor being substantially disposed along an axis of said fan; and a plurality of accessory parts being disposed at a lateral side of said refrigerant compressor and separated from said refrigerant compressor to define a cooling air passage for cooling air ejected from said fan to pass between the refrigerant compressor and the plurality of accessory parts.

3. The refrigeration unit according to claim 2, wherein each of said accessory parts define a longitudinal axis extending substantially parallel to the axis of said fan.

4. The refrigeration unit according to claim 2, wherein the longitudinal axis of one of said accessory parts is substantially flush with that of another of said accessory parts.

5. A refrigeration unit according to claim 2, wherein said accessory parts comprise an expansion valve cover and a pressure switch mounting plate.

6. The refrigeration unit according to claim 5, wherein said expansion valve cover and said pressure switch mounting plate are arranged with the longitudinal axes thereof extending substantially parallel to the axis of said fan.

7. The refrigeration unit according to claim 5, wherein the longitudinal axis of said expansion valve cover is substantially flush with that of said pressure switching mounting plate.

8. The refrigeration unit according to claim 2, wherein said accessory parts each have a surface disposed toward the cooling air passage, said surfaces being flush with each other.

9. The refrigeration unit according to claim 5, wherein said accessory parts each have a surface disposed toward the cooling air passage, said surfaces being flush with each other.

10. The refrigeration unit according to claim 2, wherein the plurality of accessory parts are arranged parallel to the axis of said fan.

* * * * *